US005954396A

United States Patent [19]

Kemnitzer

[11] Patent Number: 5,954,396

[45] Date of Patent: Sep. 21, 1999

[54] CHAIR CONSTRUCTION

[75] Inventor: Ronald B. Kemnitzer, Olathe, Kans.

[73] Assignee: Virco Mfg. Corporation

[21] Appl. No.: 09/183,843

[22] Filed: Oct. 30, 1998

[51] Int. Cl.[6] ..... A47C 1/124

[52] U.S. Cl. ..... 297/248; 297/249

[58] Field of Search ..... 297/248, 249

[56] References Cited

U.S. PATENT DOCUMENTS

| | | | |
|---|---|---|---|
| 1,198,726 | 9/1916 | Huntley | 297/248 X |
| 3,144,271 | 8/1964 | Lieberman et al. | 297/248 |
| 3,188,138 | 6/1965 | Lockshin | 297/248 |
| 3,708,207 | 1/1973 | Barecki et al. | 297/248 X |
| 5,542,159 | 8/1996 | Schultz et al. | 297/248 X |

*Primary Examiner*—Peter R. Brown
*Attorney, Agent, or Firm*—James E. Brunton

[57] ABSTRACT

A chair construction which includes connector mechanisms for rigidly anchoring chairs in assembled relation either in a linear fashion or in a curved array depending upon the positioning of the rear connector of a pair of front and rear connectors. The connector mechanisms are easily fabricated and can be readily affixed to the legs of the chair in a manner to enable the chairs by leg movement to be readily assembled and disassembled into the desired array. The connector mechanisms are specially designed and located so as to be unobtrusive and so as not to interfere with the normal use of the chair.

12 Claims, 9 Drawing Sheets

CHAIR CONSTRUCTION

BACKGROUND OF THE INVENTION

1. Field of the Invention

The present invention relates generally to chair construction. More particularly, the invention concerns a novel chair construction having connector means for releasably interconnecting together a plurality of adjacent chairs in either a generally straight line array or in a curved array.

2. Discussion of the Prior Art

It is frequently necessary in schools, churches, hotels, auditoriums, convention centers and similar public and private meeting places to provide seating arrangements which usually comprise a plurality of parallel rows of auditorium type chairs. Preferably the chairs, which typically comprise interconnected seats and backs that are supported by pairs of spaced apart front and rear legs are releasably connected together by some type of connector means, often affixed to the chair legs.

Exemplary of one type of chair coupling construction is that described in U.S. Pat. No. 3,009,738 issued to Piker. The Piker coupling means comprises primary and secondary interlocking half parts of identical configuration which are affixed to the upper portions of the front and rear chair legs. Another type of prior art ganging attachment is disclosed in U.S. Pat. No. 3,614,157 issued to Hendrickson. This ganging attachment comprises identical fittings that are attached in mutually inverted positions at vertically spaced points on the legs of folding chairs. Each of the fittings is generally channel shaped with its flanges welded to the leg and its web provided with a headed stud at one end and a slot at the other. Relative vertical movement between the chairs will engage the slotted ends of the respective fittings of one chair with the projecting studs of the adjacent chair thus interlocking the chairs against lateral separation. A somewhat similar arrangement is described in U.S. Pat. No. 3,227,487 issued to Blanchard, Jr. et al. The Blanchard et al coupling means comprises pin and plate connectors for folding chairs which are constructed so as to resist torsional stresses, while at the same time permitting the chairs by leg movement to be readily disassembled.

While the prior art chair coupling constructions generally perform in a satisfactory manner, some are rather difficult to operate and often tend to become jammed making chair separation difficult. Additionally, certain of the prior art coupling means are unduly complex making them difficult and costly to manufacture and install. Further, most of the prior art chair coupling constructions are of limited versatility and permit ganging of the chair only in a straight line configuration.

As will be better appreciated from the discussion which follows, the novel coupling means of the present invention are of a simple easy to use construction and uniquely permit the chairs to be ganged together either in a straight line or curved arrays.

SUMMARY OF THE INVENTION

It is an object of the present invention to provide a novel chair construction which includes connector means for rigidly anchoring chairs in assembled relation either in a linear fashion or in a curved array depending upon the positioning of the rear connector of a pair of front and rear connectors which comprise the connector means of the invention.

Another object of the invention is to provide a chair construction of the aforementioned character in which the connector means is easily fabricated and can be readily affixed to the legs of the chair in a manner to enable the chairs by leg movement to be readily assembled and disassembled into the desired array.

Another object of the invention is to provide a chair construction in which the connector means thereof are unobtrusive and do not interfere with the normal use of the chair.

Another object of the invention is to provide a chair construction of the character described in the preceding paragraphs which is of a simple and extremely attractive design and one which permits easy stacking of the individual chairs when they are not in use.

As will be better understood from the discussion which follows, the present invention improves upon the prior art chair construction by providing an elegantly simple, easy-to-use and highly versatile chair construction which embodies novel connector mechanisms that permit a plurality of individual chairs to be releasably interconnected together either in straight or curved rows.

DESCRIPTION OF THE INVENTION

Figure 1:
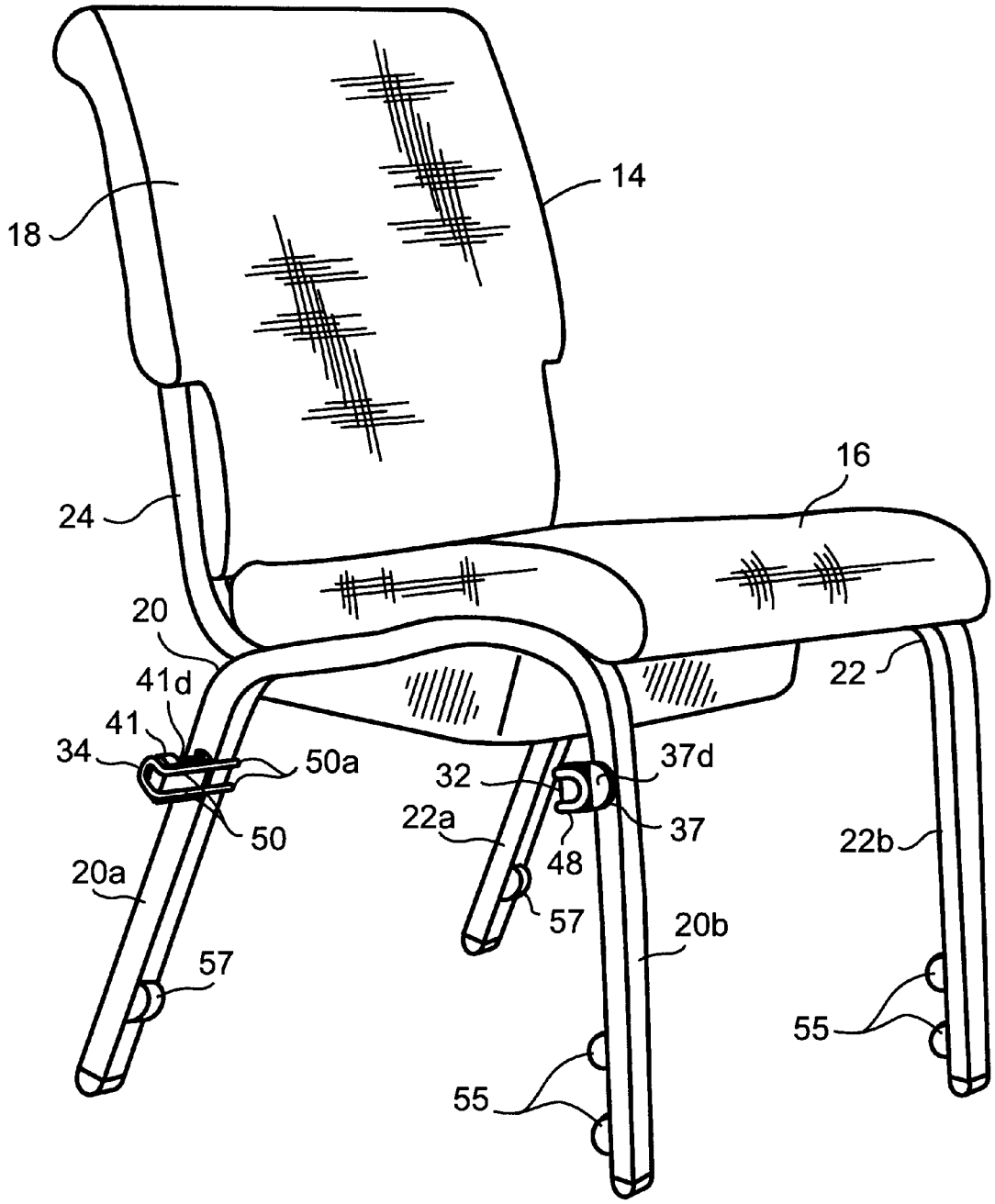
FIG. 1 is a generally perspective view of one form of chair construction of the invention.

Referring to the drawings and particularly to FIGS. 1 through 6, one form of chair construction of the present invention is there shown and generally designated by the numeral 14. As best seen in FIG. 1, the chair construction here comprises a seat portion 16 and a back rest portion 18 which is interconnected with seat portion 16. Seat portion 16 is supported by transversely spaced apart, generally U-shaped first and second leg frames 20 and 22 respectively. Leg frame 20 comprises a downwardly extending rear leg 20*a* and a downwardly extending front leg 20*b*. Similarly, leg frame 22 comprises a downwardly extending rear leg 22*a* and a downwardly extending front leg 22*b*. Back rest 18 is supported by a curved frame 24, the lower portions of which are connected to frames 20 and 22 by any suitable means such as spot welding.

Figure 2:
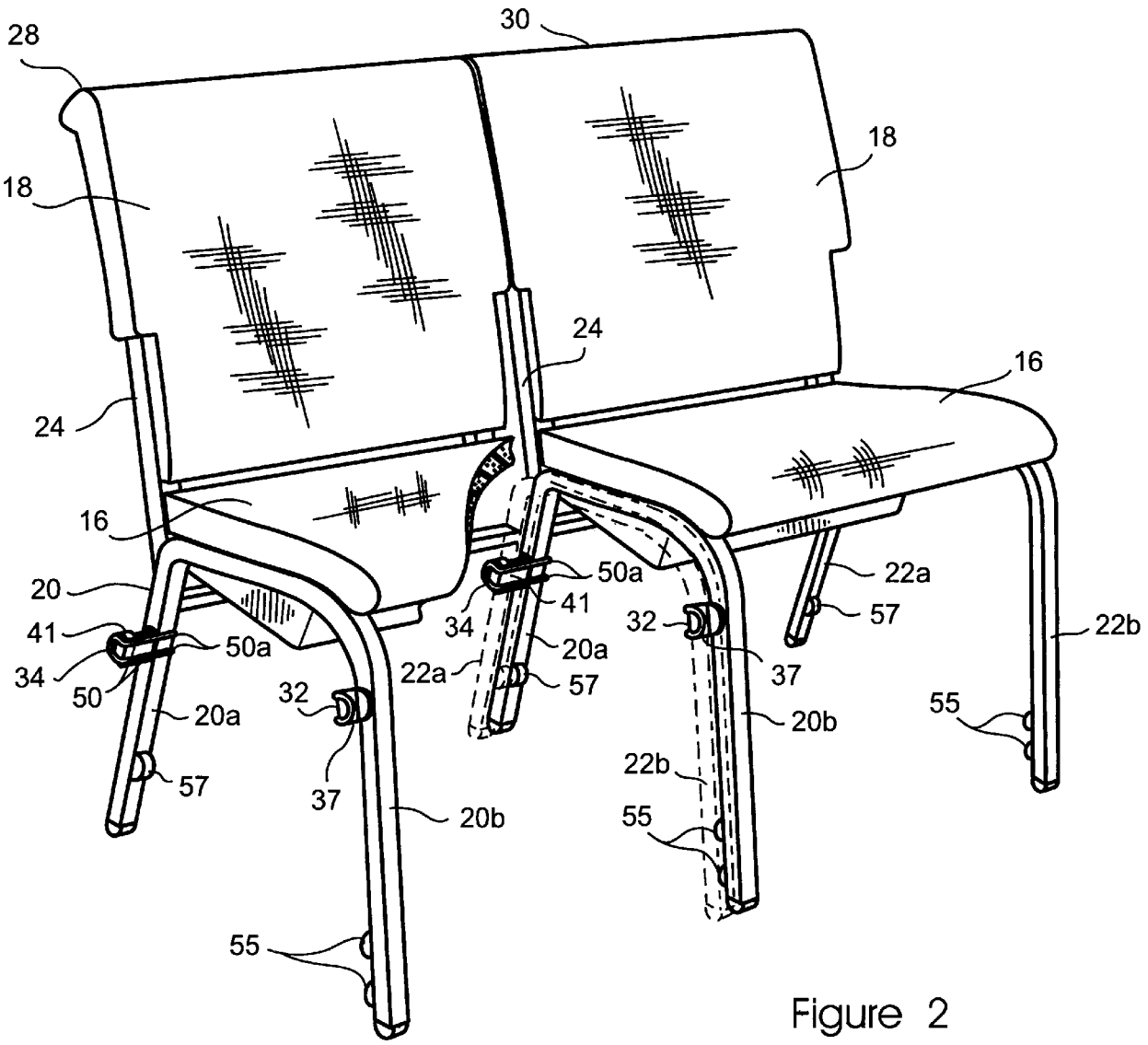
FIG. 2 is a generally perspective illustrative view showing two chairs of the invention releasably interconnected together by the novel connector means of the invention.
Figure 7:
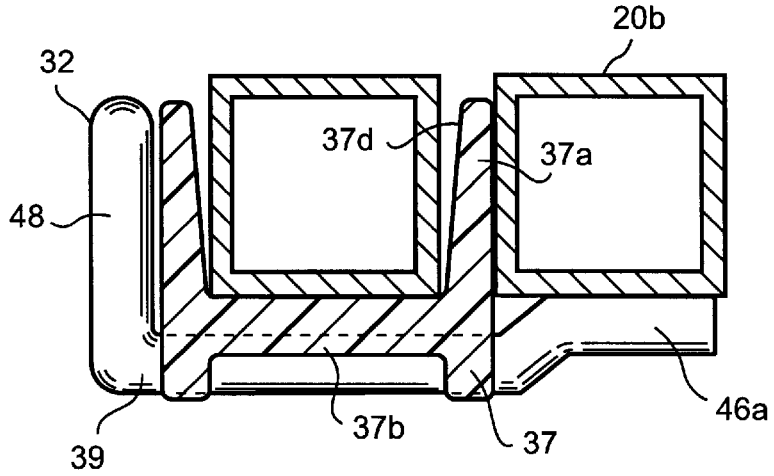
FIG. 7 is an enlarged, cross-sectional view taken along lines 7—7 of FIG. 6.
Figure 10:
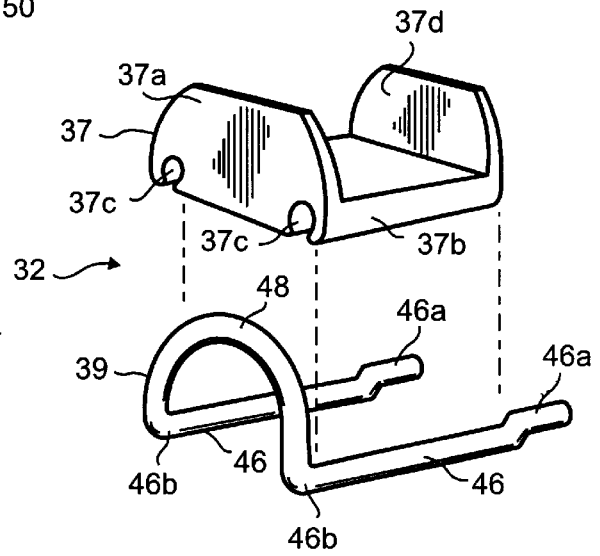
FIG. 10 is an enlarged, generally perspective, exploded view of the front connector assembly of one form of the invention.

Affixed to leg frame 20 is the novel connector means of the invention for releasably interconnecting first and second chairs 28 and 30 in an assembled relationship (FIG. 2). The connector means here comprises a front leg connector assembly 32 and a rear leg connector assembly 34. Turning particularly to FIGS. 7 and 10, the front leg connection assembly 32 can be seen to comprise a front leg connector 37 and a front leg connector support 39. Connector 37 includes a body portion 37*a* having a base 37*b*, which as shown in FIG. 10, includes a pair of spaced-apart grooves 37*c*. Body portion 37*a* is uniquely provided with a generally centered leg receiving channel 37*d* which, in a manner presently to be described is adapted to receive the front leg of an adjacently disposed chair.

Figure 8:
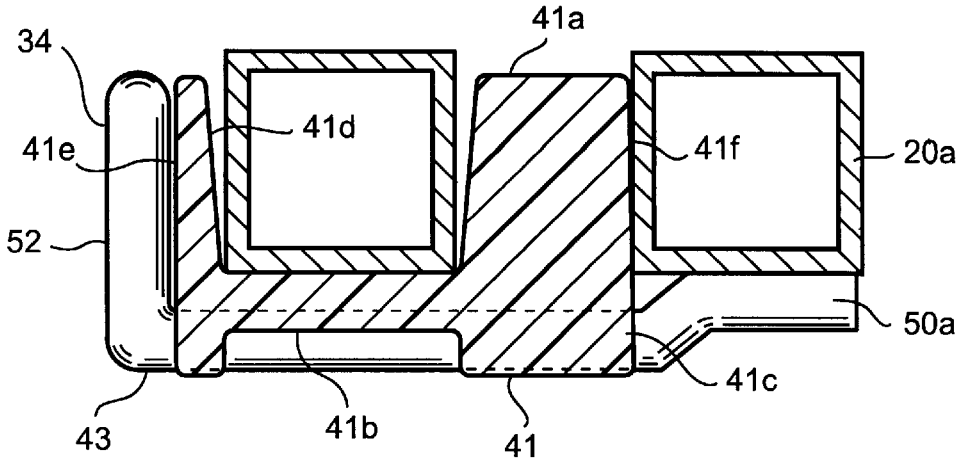
FIG. 8 is an enlarged, cross-sectional view taken along lines 8—8 of FIG. 6.
Figure 11:
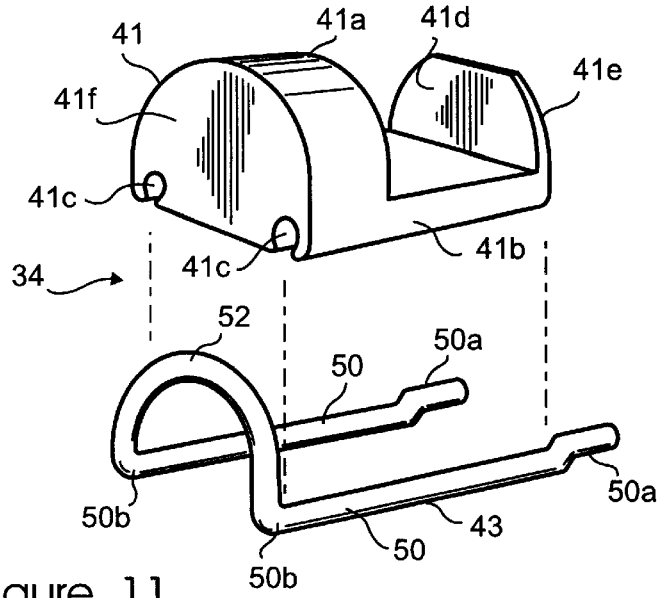
FIG. 11 is an enlarged, generally perspective, exploded view of the rear connector assembly on one form of the invention showing the connector in a first orientation to form a straight line array.
Figure 12:
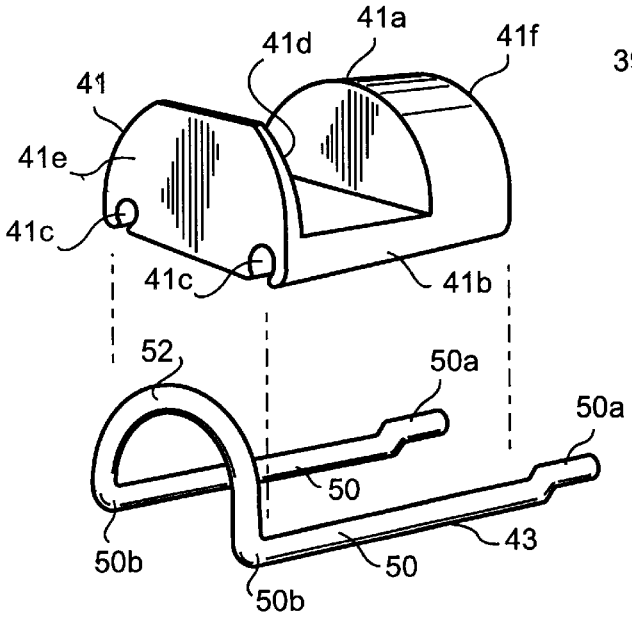
FIG. 12 is a view similar to FIG. 11, but showing the rear connector assembly in a second orientation to form a curved array of chairs.

As best seen in FIGS. 8 and 11, rear leg connector assembly 34 comprises a rear leg connector 41 and a rear leg connector support 43. Connector 41 includes a body portion 41*a* having a base 41*b* which, as shown in FIGS. 11 and 12, is provided with a pair of grooves 41*c*. Body portion 41*a* is uniquely provided with an offset or off centered leg receiving channel 41*d* which, in a manner presently to be described, is adapted to receive the rear leg of an adjacently disposed chair.

Each of the front and rear leg connector supports 39 and 43 comprises a base portion and an end wall portion. More particularly, support 39 includes a pair of spaced-apart base defining, rod-like members 46 which have first and second ends 46*a* and 46*b* respectively. Connected to ends 46*b* is a generally U-shaped end wall defining member 48. Similarly, support 43 includes a pair of spaced-apart base defining rod-like members 50 which have first and second ends 50*a* and 50*b* respectively. Connected to ends 50*b* is a generally U-shaped end wall defining member 52.

As best seen by referring to FIGS. 1 and 7, ends 46*a* of front leg connector support 39 are affixed as by welding or other suitable means to a front leg 20*b* of the chair construction of the invention. Similarly, ends 50*a* of rear leg connector support 43 are affixed as by welding or other suitable means to a rear leg 20*a* of the chair construction (see also FIGS. 8 and 9).

Figure 9:
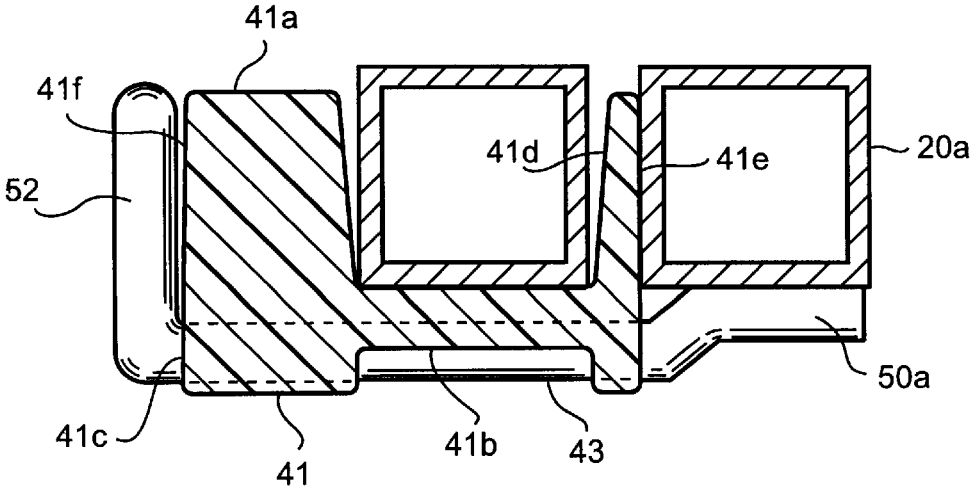
FIG. 9 is a cross-sectional view similar to FIG. 8, but showing the rear connector in a position to form a straight array.

With supports 39 and 43 affixed to the legs of the chair, connectors 37 and 41 can be readily connected thereto. More particularly, connector 37 is connected to support 39 by inserting rod-like members 46 into grooves 37*c* in the manner indicated in FIG. 10. Connector 41 is affixed to support 43 in a similar manner. However, it is to be noted that connector 41 can be connected to support 43 in either the first position shown in FIGS. 9 and 11 wherein channel 41*d* is proximate leg 20*a* or in the second position shown in FIGS. 8 and 12 wherein channel 41*d* is spaced apart from leg 20*a*. Described another way, as shown in FIGS. 9 and 11, when connector 41 is in a first position, a first end wall 41*e* of connector 41 is in engagement with rear leg 20*a*. On the other hand, when connector 41 is in the second position shown in FIGS. 8 and 12, a second, operably disposed end wall 41*f* of the connector 41 is in engagement with rear leg 20*a*.

Figure 3:
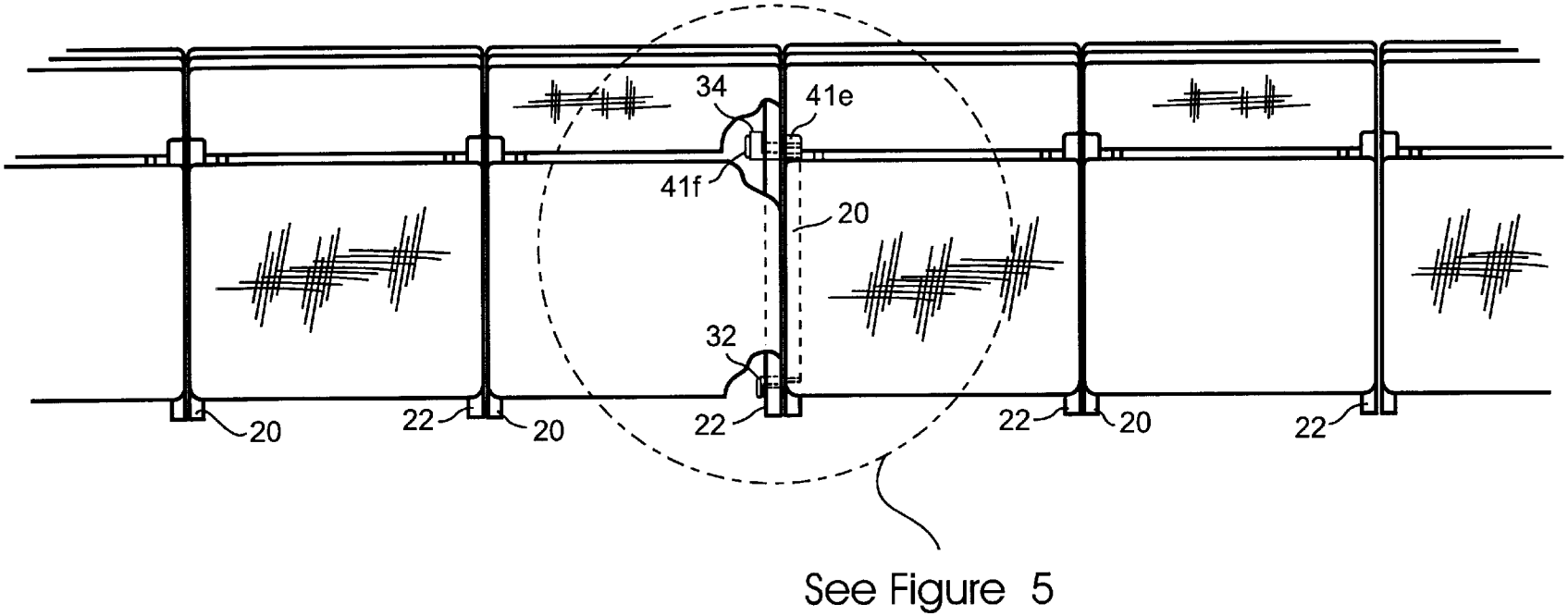
FIG. 3 is a top plan view of a straight line array of interconnected chairs of the invention partly broken away to show the connector means in a first orientation.
Figure 4:
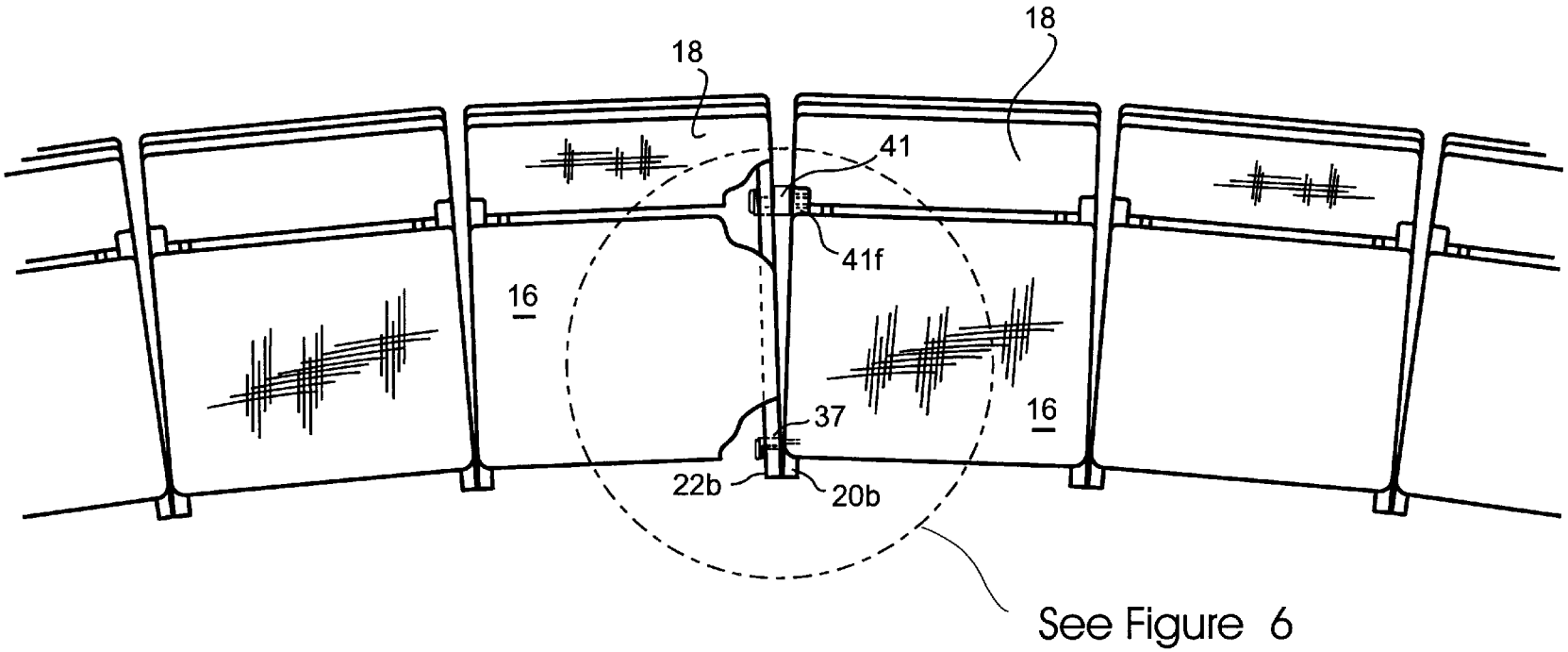
FIG. 4 is a top plan view of a curved array of interconnected chairs of the invention partly broken away to show the connector means in a second orientation.
Figure 5:
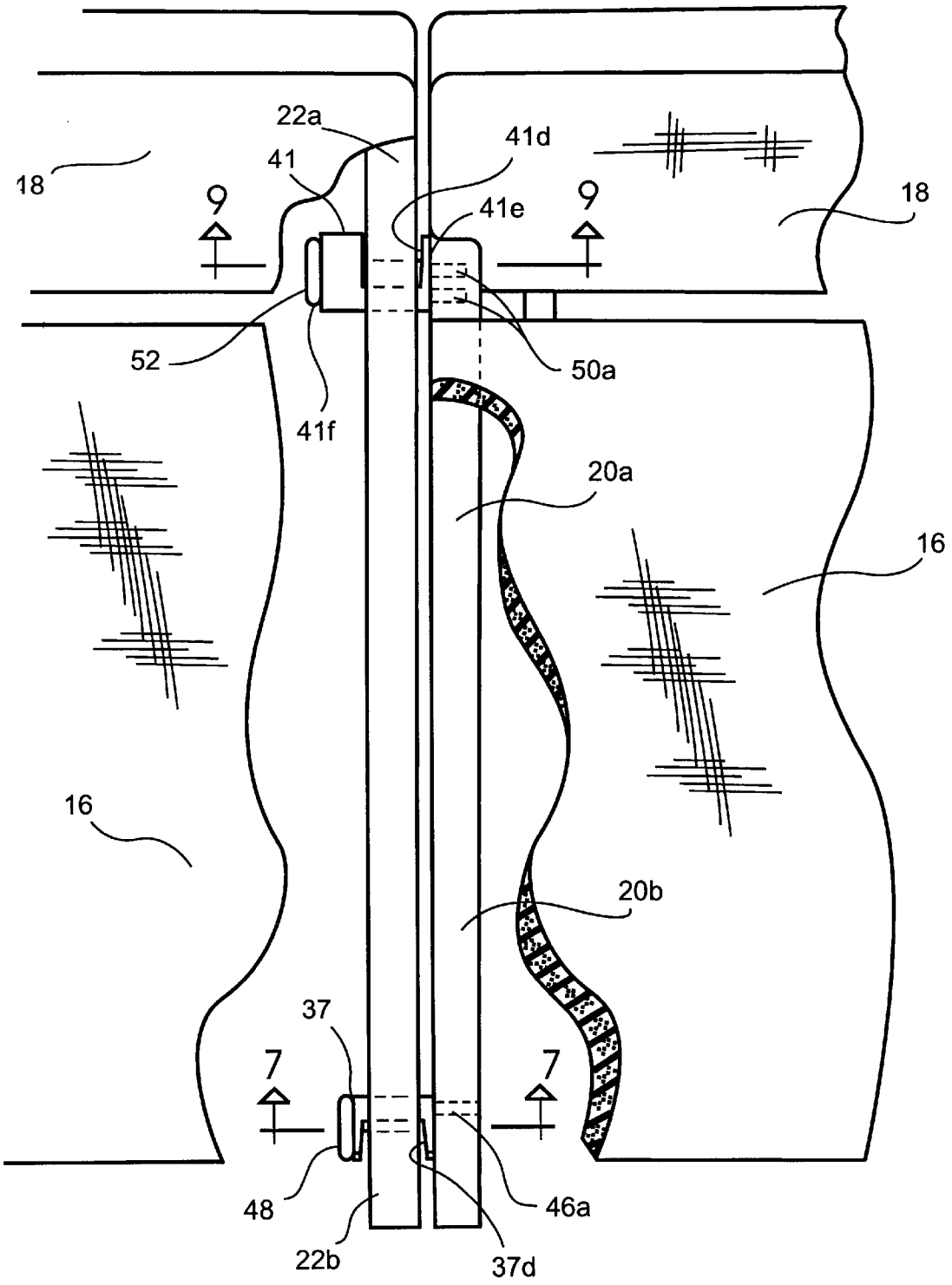
FIG. 5 is a greatly enlarged view of the area designated in FIG. 3 by the numeral 5.
Figure 6:
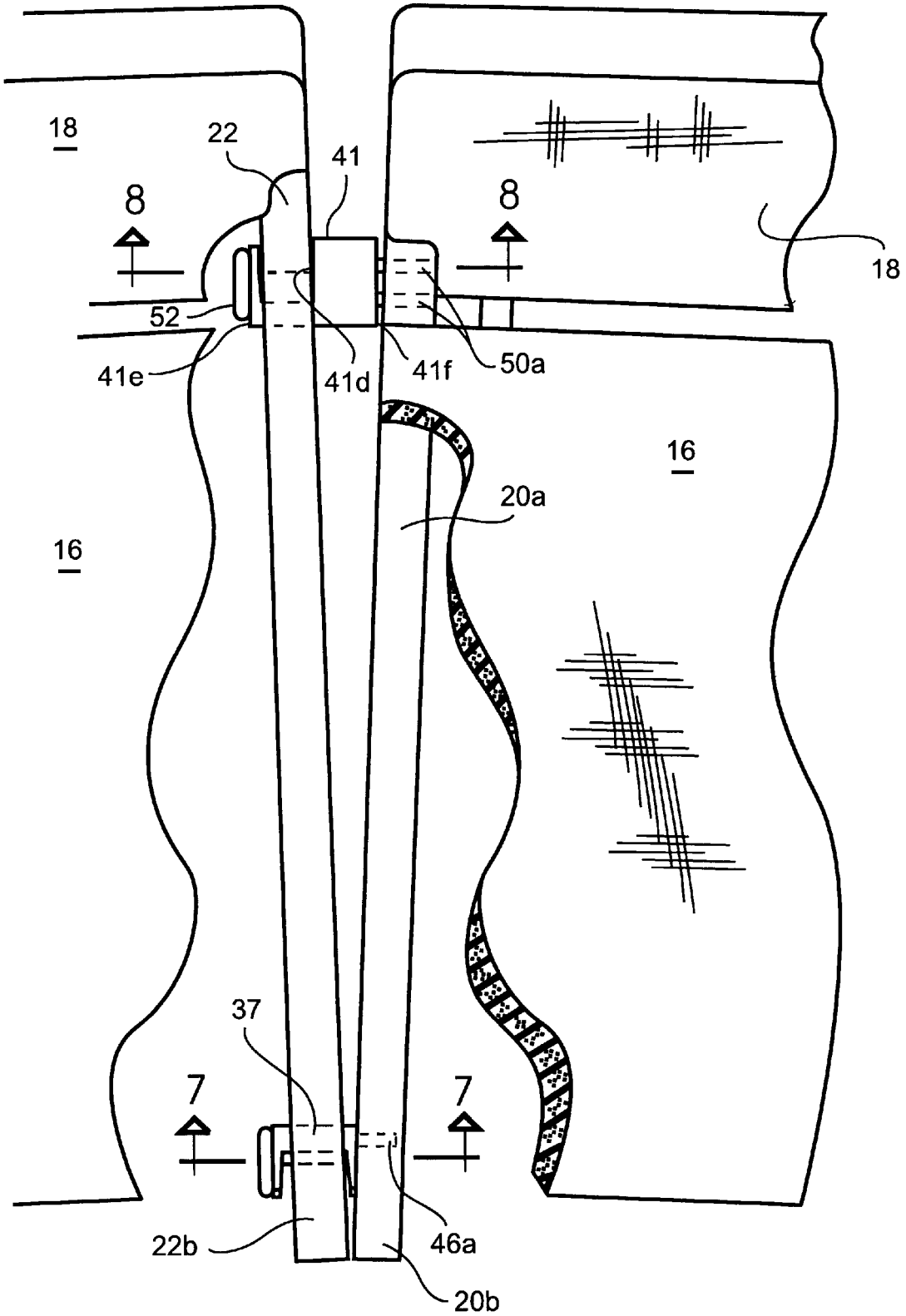
FIG. 6 is a greatly enlarged view of the area designated in FIG. 4 by the numeral 6.

The novel construction of connector 41 as described in the preceding paragraph permits the connector means of the invention to be used to interconnect a plurality of chairs, such as those shown in FIG. 3, in a generally straight line array, or, alternatively, in a curved array of the character shown in FIG. 4. As best seen in FIG. 5, when connector 41 is in the first position there shown with end wall 41*e* in engagement with rear chair leg 20*a*, channel 41*d* is located proximate leg 20*a* and when the rear leg 22*a* of an adjacent chair is positioned within the channel, a generally straight line array will be formed. Conversely, as shown in FIG. 6, when connector 41 is in the second position, end wall 41*f* is located proximate rear chair leg 20 and channel 41*d* is spaced therefrom. With this arrangement when the rear leg 22*a* of an adjacent chair is positioned within channel 41*d* a gracefully curved array of the character shown in FIG. 4 will be formed.

With the groups of chairs interconnected together in either the manner shown in FIG. 3 or in FIG. 6, it is a simple matter to disassemble the chairs by simply lifting the chair at the left end of the array relative to the next adjacent chair. Once the chair is lifted a sufficient distance so that the front and rear legs thereof clear the channels 37*d* and 41*d* (see also FIGS. 5 and 6), the chairs can be expediciously separated. To interconnect the chairs into the selected array, the reverse procedure is, of course, accomplished.

Figure 13:
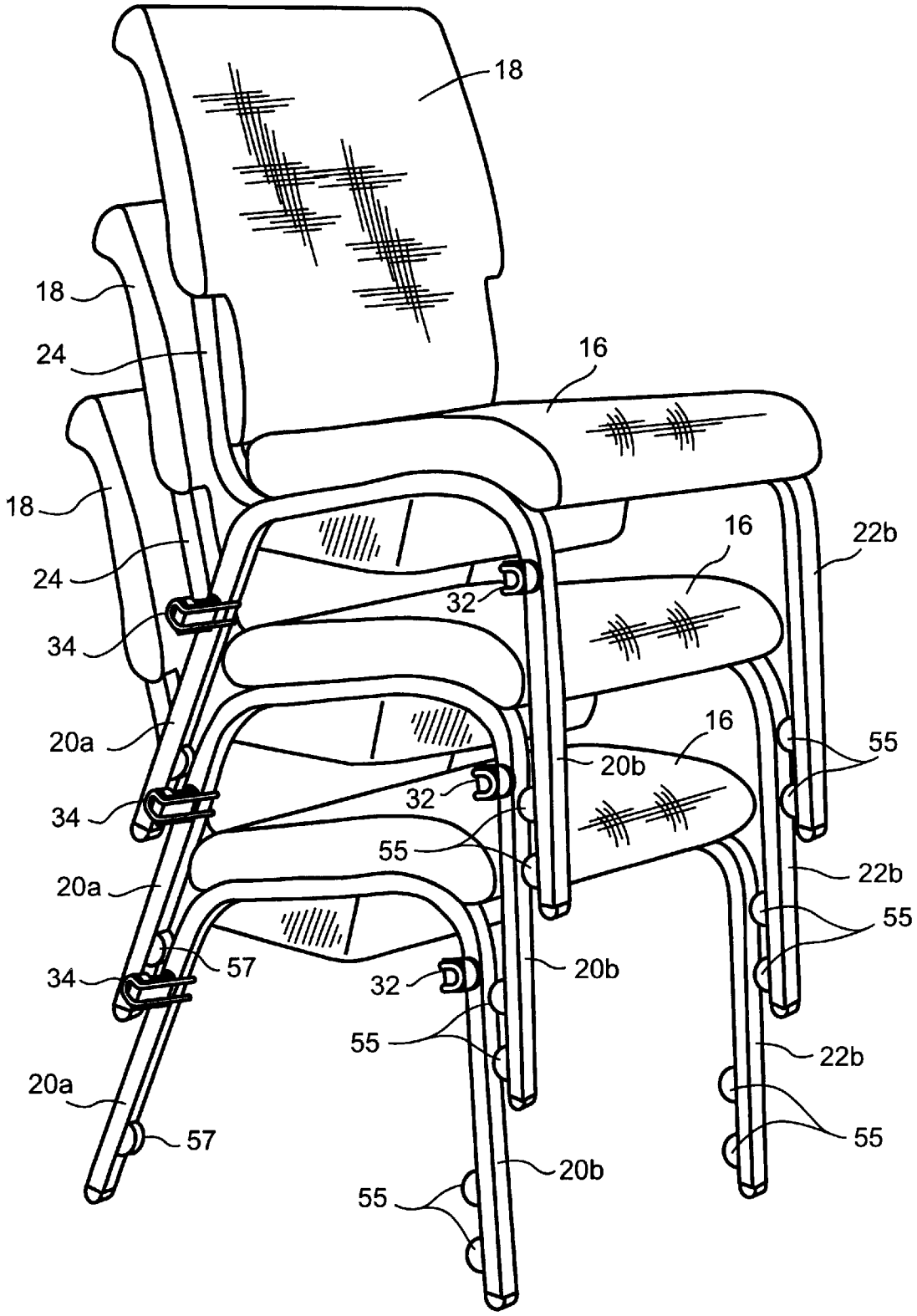
FIG. 13 is a generally perspective view of a group of chairs of the present invention in a stacked configuration.

After the chairs have been separated in the manner described in the preceding paragraphs, they can readily be stacked into the vertical array shown in FIG. 13. For this purpose, the front legs of each of the chairs is provided with a pair of semi-cylindrically shaped spaced elements 55. These spacer elements, which are affixed to the lower rear portion of the front legs 20*b* and 22*b* engage the upper front portions of the legs of the adjacent chair when the chairs are stacked in the manner shown in FIG. 13. In similar fashion, each of the rear legs 20*a* and 20*b* is provided with similarly configured spacer elements 57. When the chairs are stacked, elements 57, which are affixed to the lower inside surfaces of legs 20*a* and 20*b*, engage the upper rear surfaces of the rear legs of adjacent chair. With this novel construction, the chairs can be stacked in a stable configuration for transport and storage.

Spaced elements 55 and 57 as well as connectors 37 and 41 are preferably molded from a thermoplastic rubber or like material. The chair legs and back supporting frames, on the other hand, are preferably formed from a tubular steel or aluminum material although other suitable high strength materials could be used.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In an improved chair construction of the type having a seat portion, a back rest portion, a pair of downwardly and rearwardly extending transversely spaced rear legs and a pair of downwardly and forwardly extending transversely spaced front legs, the improvement comprising connector means for releasably interconnecting first and second chairs in an assembled relation, said connector means comprising:

(a) a front leg connector connected to the front leg of the first chair and extending therefrom, said front leg connector having a channel for receiving the front leg of the second chair; and (b) a rear leg connector connected to the rear leg of the first chair and extending therefrom, said rear leg connector comprising a body portion having an offset channel for receiving the rear leg of the second chair, said body portion having a first end wall engagable with the rear leg of the first chair for positioning said offset channel proximate the rear leg of said first chair and a second end wall engagable with the rear leg of the first chair for positioning said offset channel in a spaced apart relationship with the rear leg of the first chair.

2. An improved chair construction as defined in claim 1 in which said connector means further comprises:

(a) a front leg connector support connected to the front leg of the first chair for supporting said front leg connector; and (b) a rear leg connector support connected to the rear leg of the first chair for removably supporting said rear leg connector selectively in first and second positions.

3. An improved chair construction as defined in claim 2 in which said front leg connector support and said rear leg connector support each comprise:

(a) a base having first and second ends, said first end being connected to one of said front and rear legs of the first chair; and (b) an end wall connected to said second end of said base.

4. An improved chair construction as defined in claim 3 in which said end wall is generally U-shaped and extends substantially perpendicularly from said base.

5. An improved chair construction as defined in claim 3 in which said body portion of each said connector includes a pair of spaced apart grooves and in which said base of each said leg connector support comprises a pair of spaced-apart rods receivable within said spaced apart grooves.

6. In an improved chair constriction of the type having a seat portion, a back rest portion, a pair of downwardly and rearwardly extending transversely spaced rear legs and a pair of downwardly and forwardly extending transversely spaced front legs, the improvement comprising connector means for releasably interconnecting first and second chairs in an assembled relation, said connector means comprising:

(a) a front leg connector assembly connected to the front leg of the first chair and extending therefrom, said front leg connector assembly comprising:

(i) a front leg connector having a channel for receiving the front leg of the second chair;

(ii) a front leg connector support for supporting said front leg connector; and (b) a rear leg connector assembly connected to the rear leg of the first chair and extending therefrom, said rear leg connector assembly comprising:

(i) a rear leg connector having a body portion including an offset channel for receiving the rear leg of the second chair, said body portion having a first end wall engagable with the rear leg of the first chair for positioning said offset channel proximate the rear leg of said first chair and a second end wall engagable with the rear leg of the first chair for positioning said offset channel in a spaced apart relationship with the rear leg of the first chair; and (ii) a rear leg connector support for supporting said rear leg connector.

7. An improved chair construction as defined in claim 6 in which said front leg connector support and said rear leg connector support each comprise:

(a) a base having first and second ends, said first end being connected to one of said front and rear legs of the first chair; and (b) an end wall connected to said second end of said base.

8. An improved chair construction as defined in claim 7 in which said end wall is generally U-shaped and extends substantially perpendicularly from said base.

9. An improved chair construction as defined in claim 8 in which said body portion of each of said front and rear leg connectors include a pair of spaced apart grooves and in which said base of each said front and rear leg connector supports comprises a pair of spaced-apart rods receivable within said spaced apart grooves.

10. In an improved chair construction of the type having a seat portion, a back rest portion, a pair of downwardly and rearwardly extending transversely spaced rear legs and a pair of downwardly and forwardly extending transversely spaced front legs, the improvement comprising connector means for releasably interconnecting first and second chairs in an assembled relation, said connector means comprising:

(a) a front leg connector assembly connected to the front leg of the first chair and extending therefrom, said front leg connector assembly comprising:

(i) a front leg connector including a body portion having a pair of spaced-apart grooves and channel for receiving the front leg of the second chair, (ii) a front leg connector support for supporting said front leg connector including a base comprising spaced-apart rods receivable within said spaced-apart grooves in said front leg connector, said rods having first and second ends, said first end being connected to said front leg; and (b) a rear leg connector assembly connected to the rear leg of the first chair and extending therefrom, said rear leg connector assembly comprising:

(i) a rear leg connector including a body portion having a pair of spaced-apart grooves and an offset channel for receiving the rear leg of the second chair, said body portion having a first end wall engagable with the rear leg of the first chair for positioning said offset channel proximate the rear leg of said first chair and a second end wall engagable with the rear leg of the first chair for positioning said offset channel in a spaced apart relationship with the rear leg of the first chair; and (ii) a rear leg connector support for supporting said rear leg connector including a base comprising spaced-apart rods receivable within said spaced-apart grooves in said body portion of said rear leg connector, said rods having first and second ends said first ends being connected to said rear leg.

11. An improved chair construction as defined in claim 10 in which said front leg connector support and said rear leg connector support each comprise an end wall connected to said base thereof, said end wall being generally U-shaped and extending substantially perpendicularly from said base.

12. An improved chair construction as defined in claim 10 further including a pair of spacer elements connected to one of said front legs and a spacer element connected to one of said rear legs.

* * * * *